US009719729B2

(12) United States Patent
Rottinghaus

(10) Patent No.: US 9,719,729 B2
(45) Date of Patent: Aug. 1, 2017

(54) HEATING SYSTEM FOR HEATING FLUID IN A TANK

(71) Applicant: Vince Rottinghaus, Charles City, IA (US)

(72) Inventor: Vince Rottinghaus, Charles City, IA (US)

( * ) Notice: Subject to any disclaimer, the term of this patent is extended or adjusted under 35 U.S.C. 154(b) by 23 days.

(21) Appl. No.: 14/249,784

(22) Filed: Apr. 10, 2014

(65) Prior Publication Data

US 2015/0292806 A1 Oct. 15, 2015

(51) Int. Cl.

| | |
|---|---|
| ***F24D 17/00*** | (2006.01) |
| ***F24D 3/02*** | (2006.01) |
| ***F28D 1/02*** | (2006.01) |
| ***F24H 1/06*** | (2006.01) |

(52) U.S. Cl.

CPC ..... *F28D 1/0213* (2013.01); *F24H 1/06* (2013.01)

(58) Field of Classification Search

USPC ..... 122/20 R, 19.1, DIG. 10; 237/12.3 B, 237/12.3 C, 19, 45, 56, 66, 63, 8 A, 8 D, 237/2 A, 59; 404/71, 95

See application file for complete search history.

(56) References Cited

U.S. PATENT DOCUMENTS 3,379,146 A * 4/1968 Sluiter ..... F23G 5/46 110/234
3,380,658 A * 4/1968 Stasz ..... B60S 3/044 134/151
4,178,907 A * 12/1979 Sweat, Jr. ..... F24H 6/00 122/20 B
4,228,767 A * 10/1980 Smith ..... F22B 9/12 110/245
5,020,721 A * 6/1991 Horne ..... F24H 1/186 122/14.3
5,838,880 A * 11/1998 Brooks, Jr. ..... E02D 3/11 126/343.5 A
6,126,081 A * 10/2000 Calvin ..... F24H 1/08 237/12.3 B
6,761,135 B1 * 7/2004 Becktold ..... B08B 3/026 122/396
7,441,986 B2 * 10/2008 Rottinghaus ..... A01G 25/095 237/12.3 B
7,735,458 B2 * 6/2010 Stapensea ..... F24D 17/00 122/20 R
8,490,582 B1 * 7/2013 Wingen ..... F22B 1/1807 122/406.1
8,534,324 B2 9/2013 Schulman
2012/0299283 A1 11/2012 Harrell

* cited by examiner

*Primary Examiner* — Gregory A Wilson

(74) *Attorney, Agent, or Firm* — Zarley Law Firm, P.L.C.

(57) ABSTRACT

A heating system for heating fluid in a tank includes a heating device for heating and pumping water to a tank heater via a hose. The tank heater has a pump connected to a heat exchanger. The heat exchanger has a plurality of tubes disposed in a housing that receive fluid from the tank. The heating device pumps hot water through the heat exchanger to transfer heat to fluid in the tubes and the back to the heating device. The pump circulates fluid within the heat exchanger.

5 Claims, 2 Drawing Sheets

HEATING SYSTEM FOR HEATING FLUID IN A TANK

BACKGROUND OF THE INVENTION

This invention is directed to a heating system for heating fluid in a tank. More particularly this invention is directed to a heating system for heating fluid at remote locations and job sites.

Heating systems are well known in the art. While heating systems exist, few are able to be used at remote locations to heat fluid in a tank. Thus, a need exists in the art for a device that addresses this deficiency.

An objective of the present invention is to provide a heating system to heat fluid in a tank at a remote location.

Another objective of the present invention is to provide a heating system that is easy and inexpensive to use.

These and other objectives will be apparent to those skilled in the art based upon the following written description, drawings and claims.

SUMMARY OF THE INVENTION

A heating system for heating fluid in a tank includes a heating device for heating and pumping water to a tank heater via a hose. The tank heater has a pump connected to a heat exchanger. The heat exchanger has a plurality of tubes disposed in a housing that receive fluid from the tank. The heating device pumps hot water through the heat exchanger to transfer heat to fluid in the tubes and then back to the heating device. The pump circulates fluid within the heat exchanger.

DETAILED DESCRIPTION OF THE PREFERRED EMBODIMENTS

Figure 1:
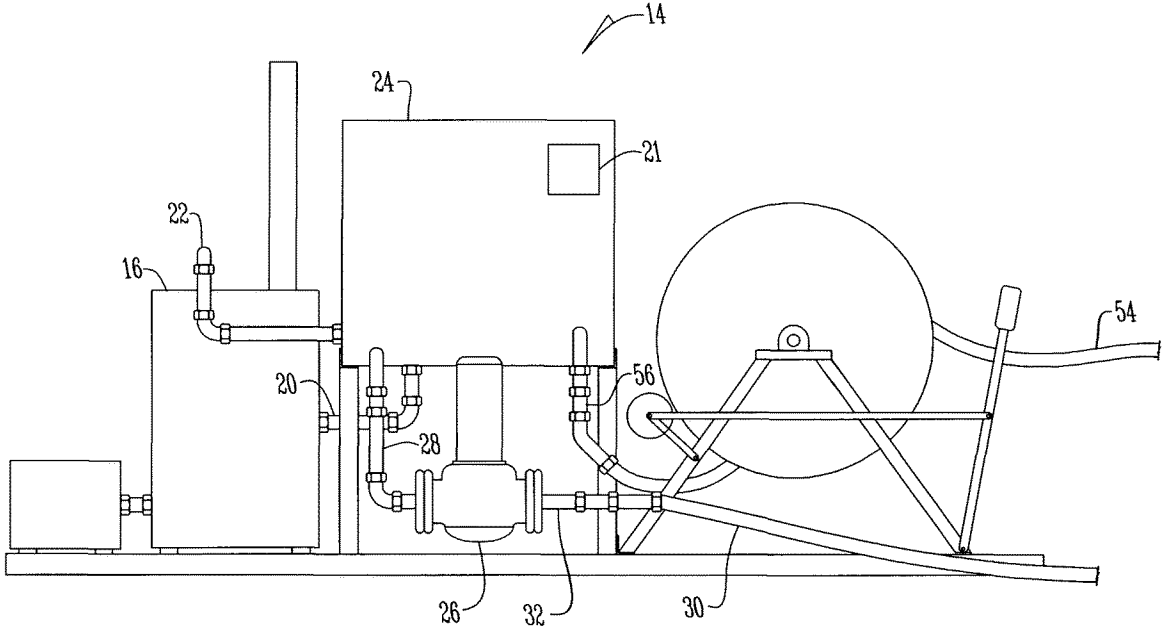
FIG. 1 is a side view of a heating device for a heating system.
Figure 2:
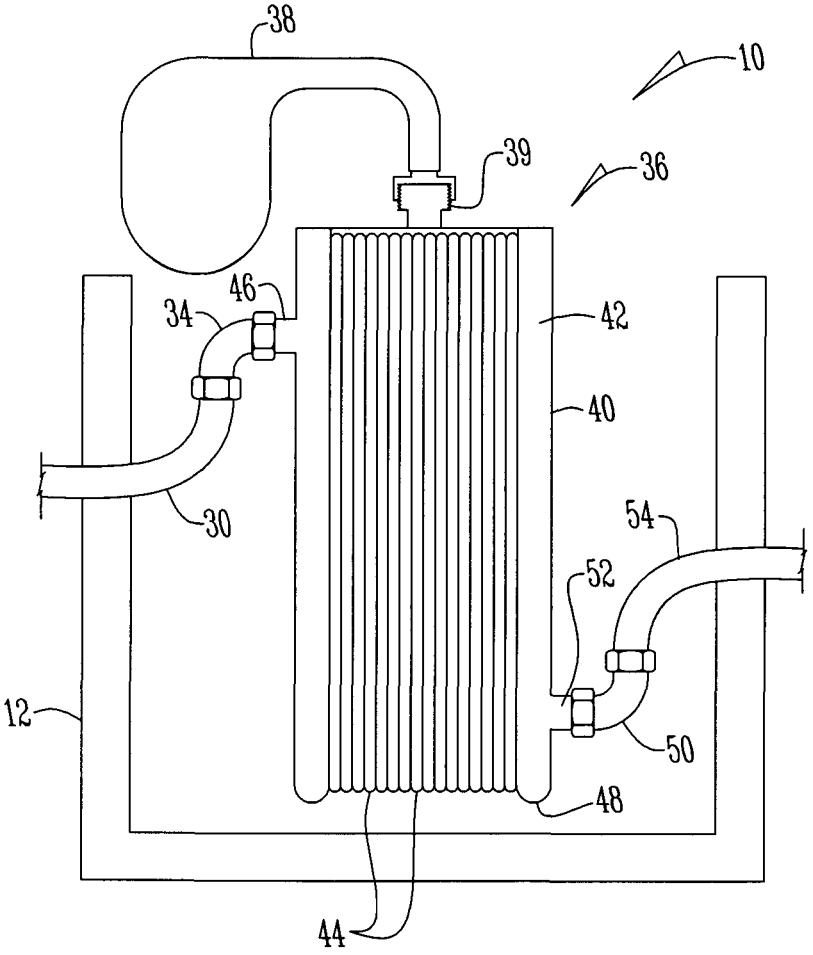
FIG. 2 is a tank heater for a heating system.

Referring to the Figures, a heating system 10 for heating fluid in a tank 12 includes a heating device 14 for heating water. The heating device 14 is of any type and preferably is the heating device as disclosed in U.S. Pat. No. 7,441,986 incorporated here by reference in its entirety. Such a heating device 14 includes a water heater 16 that is in fluid communication with a reservoir tank 24 by conduits 20 and 22. More specifically, water from the reservoir tank 24 is drawn into the water heater 16 via conduit 20. Connected to the reservoir tank 24 is a thermostat 21 that controls the temperature of the water. After passing through water heater 16, hot water is returned to the reservoir tank 24 via conduit 22.

Pump 26 draws hot water from the reservoir tank via conduit 28 and pumps water to a hose 30 via conduit 32. Hose 30 is connected at its opposite end to a fluid inlet 34 of a tank heater 36. Preferably the tank heater 36 has a pump

38 such as a sump pump or the like that is threadably connected to a first end 39 of a heat exchanger 40.

The heat exchanger 40 has a housing 42 that encloses a plurality of elongated corrugated tubes 44. The fluid inlet 34 is threadably connected to and in fluid communication with an inlet port 46 on the housing 42. At the opposite or second end 48 of the heat exchanger 40, a fluid outlet 50 is threadably connected to and in fluid communication with a discharge port 52.

A second hose 54 is connected to the fluid outlet 50 at one end and to the reservoir tank 24 via conduit 56. Alternatively, second hose 54 is connected to the fluid inlet 34 of a second tank heater 36. This process may be repeated in order to connect multiple tank heaters to heat multiple tanks 12.

In operation, tank heater 36 is placed in a tank 12 such as a fracking tank or the like. Heating device 14 pumps hot water from the reservoir tank 24 through hose 32 to the heat exchanger 40. Fluid from the tank 12 flows into tubes 44 and is heated by the hot water that flows from the inlet port 46 to discharge port 52. Pump 38 pumps fluid out of tubes 44 when the fluid reaches a certain level. The hot water leaves the heat exchanger 40 and returns to the reservoir tank 24 or to a second tank heater.

Thus a heating system has been disclosed that at the very least meets all of the stated objectives.

What is claimed is:

1. A heating system for heating fluid in a tank, comprising:

a heating device having a water heater connected to a reservoir tank by a first conduit;

a pump connected to the reservoir tank by a second conduit and to a hose by a third conduit;

a tank heater having a heat exchanger that includes a plurality of tubes disposed within a housing, an inlet port, an outlet port, and a second pump connected to one end of the heat exchanger, wherein the hose is connected to the inlet port of the heat exchanger; and a second hose that is connected to the reservoir tank on one end by a fourth conduit and on another end to the discharge port of the heat exchanger.

2. The system of claim 1 wherein the second pump is a sump pump.

3. The system of claim 1 further comprising a thermostat connected to the reservoir tank.

4. The system of claim 1 wherein the tank is a fracking tank.

5. A heating system for heating fluid in a tank, comprising:

a heating device having a water heater connected to a reservoir tank by a first conduit;

a pump connected to the reservoir tank by a second conduit and to a hose by a third conduit;

a tank heater having a heat exchanger that includes a plurality of tubes disposed within a housing, an inlet port, an outlet port, and a second pump connected to one end of the heat exchanger, wherein the hose is connected to the inlet port of the heat exchanger; and a second hose that is connected to the reservoir tank on one end by a fourth conduit and on another end to a discharge port of the heat exchanger the outlet port.

* * * * *